United States Patent [19]

Fujita et al.

[11] Patent Number: 4,658,974

[45] Date of Patent: Apr. 21, 1987

[54] TRANSPARENT LIQUID CONTAINER BOTTLE WITH TINTED LABEL AND BASE CUP

[75] Inventors: Takashi Fujita, Nishinomiya; Yuko Goto, Ashiya; Kenji Nishikawa, Nara, all of Japan

[73] Assignee: Suntory Limited, Osaka, Japan

[21] Appl. No.: 814,764

[22] Filed: Dec. 30, 1985

[30] Foreign Application Priority Data

Jan. 8, 1985 [JP] Japan ..... 60-740[U]

[51] Int. Cl.[4] ..... B65D 1/02; B65D 23/00; B65D 23/08

[52] U.S. Cl. ..... 215/12 R; 215/1 C; 215/100 R; 229/89; 40/310

[58] Field of Search ..... 215/1 R, 1 C, 12 R, 215/100 R, 365; 40/310; 229/89

[56] References Cited

U.S. PATENT DOCUMENTS

| | | | |
|---|---|---|---|
| 2,810,978 | 10/1957 | Chapman | 215/1 R X |
| 2,905,351 | 9/1959 | Lerner | 215/100 R |
| 4,190,168 | 2/1980 | Jacques | 215/12 R |
| 4,219,124 | 8/1980 | Amberg | 215/12 R |
| 4,585,679 | 4/1986 | Karabedian | 215/12 R X |

FOREIGN PATENT DOCUMENTS

| | | | |
|---|---|---|---|
| 718957 | 11/1966 | Italy | 215/1 R |
| 15527 | of 1896 | United Kingdom | 40/310 |

*Primary Examiner*—William Price
*Assistant Examiner*—Sue A. Weaver
*Attorney, Agent, or Firm*—Bachman & LaPointe

[57] ABSTRACT

A transparent liquid container bottle features a label with a tinted backside which imparts a tinted appearance to the contained liquid. The bottle has a cylindrical body, a hemispherical top and a base cup. The base cup may be tinted to match the backside of the label. The label covers only part of the cylindrical body, leaving an unlabeled section with a dimension 0.1 to 2.0 times, or 0.5 to 1.2 times preferably, the diameter of the body.

5 Claims, 3 Drawing Figures

TRANSPARENT LIQUID CONTAINER BOTTLE WITH TINTED LABEL AND BASE CUP

BACKGROUND OF THE INVENTION

The present invention relates generally to a liquid container bottle. More specifically, the invention relates to a transparent bottle for containing a transparent liquid, to which a colored label is adhered in order to improve the appearance of the liquid therein.

In the recent years, various soft drinks have been put on the market in various types of containers. Conventionally, many of such soft drinks have contained some coloring or color-adjusting agents providing the drink some color or adjusting the natural color of the drink. However, there recently has been increasing concern about the effects of such coloring or color-adjusting agents on health. As a result, in order to avoid the effects of coloring or color-adjusting agents, soft drinks nowadays contain less of these agents or even none at all. This, in turn, results in loss of color of the drinks.

At the same time, transparent liquid container bottles, such as synthetic resin bottles, have become popular due to their convenience for both sale and transport. Such bottles are generally not colored and tend to reveal the color of the containing liquid as is. Therefore, when a clear drink is contained in a clear transparent bottle, the fact that the drink is clear will be clearly visible through the bottle.

In general, customers tend to anticipate the flavor of the drink from its color. Therefore, customers often have trouble selecting from among different types of clear beverages since they cannot predict the taste from the untinted appearance of the drink. Furthermore, the lack of color may discourage customers from drinking such beverages. Therefore, in order to facilitate beverage selection by customers and to encourage consumption, it would be preferable to tint the beverage.

Therefore, it is an principle object of the present invention to provide a colored appearance for untinted soft drinks contained in a transparent bottle.

SUMMARY OF THE INVENTION

In order to accomplish the above-mentioned and other objects, a transparent liquid container bottle, according to the present invention, has a label adhered to its outer periphery. The backside of the label is tinted with a color corresponding to the kind of liquid in the bottle. The label is applied in such a manner that the color in the backside of the label can be seen through the liquid and the bottle due to reflection and refraction of light.

In order to make the liquid in the bottle appear to customers to be tinted, the upper portion of the bottle is not labeled. The height of this unlabeled section may be 0.1 to 2.0 times the diameter of the bottle and the width of the label is greater than half of the circumference of the bottle.

More preferably, the bottle will have an essentially hemispherical upper shoulder section between the bottle body and the bottle head. Also, the cross-section of the bottle must consist only of one or more sequence of curves, such as circles, ellipses and so forth.

Alternatively, the bottle can be of conical configuration with a round periphery.

According to one aspect of the invention, a transparent liquid container bottle comprises a transparent bottle body designed to be filled to a predetermined level with a transparent liquid, and a label adhering to and encircling the bottle body, the surface of the label facing the bottle body being uniformly tinted, whereby the liquid appears to be tinted.

The transparent liquid container bottle further comprises means defining a relatively narrow opening at the top of the bottle body and a shoulder section smoothly conjoining the bottle body and the opening means, and wherein the predetermined level lies in the shoulder section near the opening means.

The bottle body and the shoulder section are strictly curvilinear in cross-section. The bottle body is essentially cylindrical and has an unlabeled section between a top edge of the label and a lower edge of the shoulder section, the top-to-bottom dimension of the unlabeled section being in the range of 0.1 to 2.0 times the diameter of the bottle body. Preferably, the dimension of the unlabeled section lies in the range of 0.5 to 1.2 times the diameter of the bottle body.

The transparent liquid container bottle further comprises a base cup fixed to the bottom of the bottle body and tinted to match the color of the tinted surface of the label.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
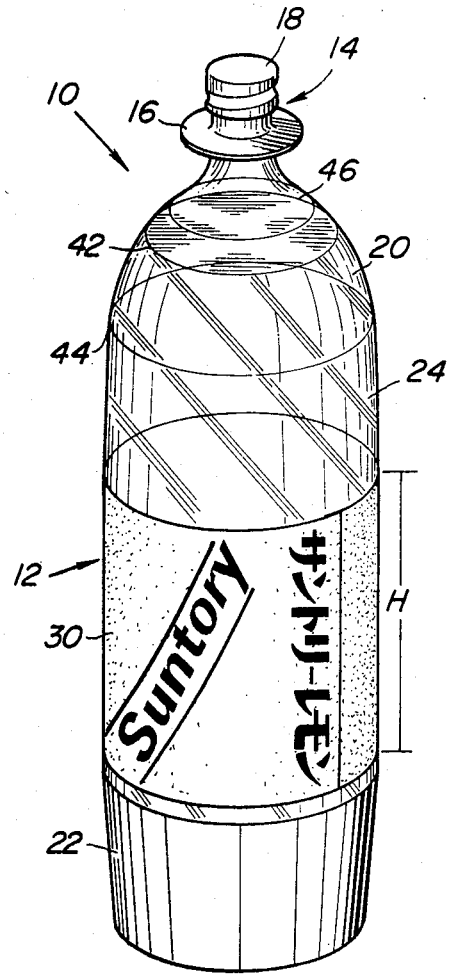
FIG. 1 is a perspective view of the preferred embodiment of a transparent liquid container bottle with a label with a tinted backside surface, according to the present invention.
Figure 2:
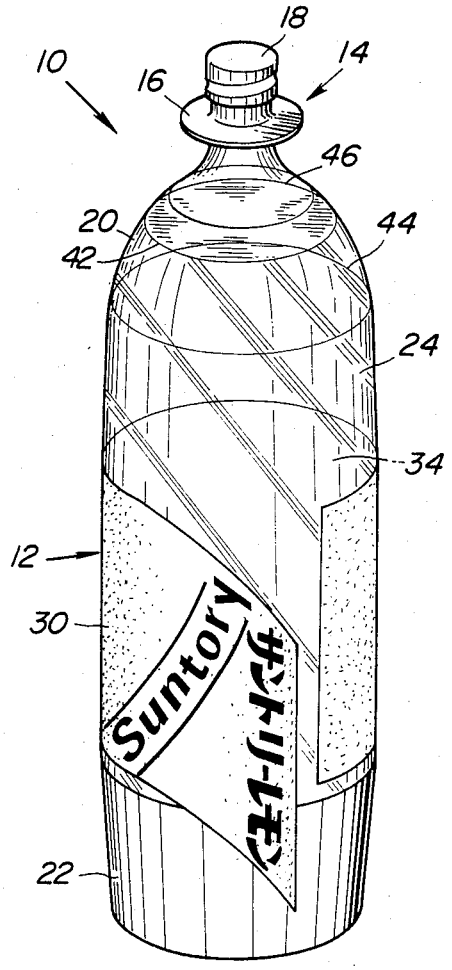
FIG. 2 is a perspective view of the preferred embodiment of the bottle, in which the label is partially removed from the bottle surface.
Figure 3:
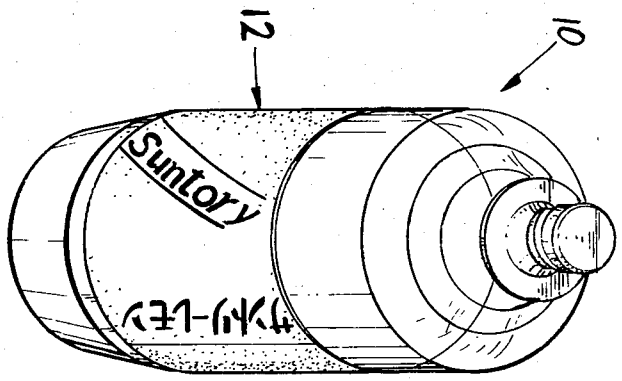
FIG. 3 is a perspective view of the preferred embodiment of the bottle viewed obliquely from above.

Referring now to the drawings, the preferred embodiment of a transparent liquid container bottle 10 is made of a synthetic resin, such as PET (polyethylene terephthalate). The bottle 10 has a generally cylindrical container body 12 and a cylindrical bottle head 14 with a radial flange 16. The top of the bottle head 14 is open to allow decanting of the liquid, such as a soft drink, in the container. A closure cap 18 is engageable to the top of the bottle head to seal the open top of the bottle head 14 in a liquid-tight manner. The bottle head 14 is significantly smaller in diameter than the container body 12. A hemispherical shoulder section 20 connects the bottle head 14 and the container body 12. A base cup 22 is attached to the lower end of the container body 12.

The disc-like flange 16 extends far enough radially from the bottle head 14 in a plane lying perpendicular to the longitudinal axis of the bottle. The flange serves as a retainer for holding the bottle in a bottling and sealing machine. Also, the flange 16 is sometimes used for gripping during fabrication. Furthermore, the flange 16 allows customers to conveniently grip the bottle head 14 beneath the flange for carrying. Therefore, the flange 16 serves as a grip preventing the bottle 10 from slipping out of the customer's hand.

A label 30 is glued to the outer periphery of the container body 12 in a per se well-known manner. Throughout the disclosure and appended claims, the word "obverse surface" will mean the label surface exposed to the outside and, on which the trademark, symbol, the name and type of the liquid and so forth are printed. Similarly, the words "reverse surface" or "inside" means the surface of the label facing the outer periphery of the container body.

In the preferred embodiment, all or most of the reverse surface of the label 30 is colored or tinted. In the preferred embodiment, the coloring on the inside of the label 30 is printed with a paint which is not soluble by the adhesive used to stick the label onto the outer periphery of the container body 12. Alternatively, in cases where an adhesive-soluble paint must be used to color the inside 34 of the label, the adhesive may be applied only to relative small areas of the inside of the label which are left uncolored.

The color to be used on the inside of the label should be selected according to the kind of liquid to be contained in the bottle 10. For example, when the liquid is lemon juice or a lemon-flavored beverage, the inside surface 34 of the label 30 may be colored lemon-yellow. Also, the base cup 22 may be advantageously tinted the same color as the inside surface of the label. Therefore, in the case of the inside surface of the label being colored lemon-yellow, at least the inside of the base cup 22 will also be tinted lemon-yellow. In practice, the base cup 22 is made of a colored resin, which matches the color of the inside surface of the label 30. Therefore, the outer surface of the base cup 22 will also be the same color as the inside surface of the label 30. The color of the outer surface of the base cup 22 will conveniently serve as an indication of the contained liquid.

As will be appreciated from the drawings, the height H of the label 30 is chosen so as to leave an unlabeled upper section 24 with a height 0.1 to 2.0 times the diameter of the container body 12, preferably 0.5 to 1.2 times the container body diameter. The circumference of the label 30 should be greater than half of the circumference of the container body.

The labeled bottle 10 is filled with a liquid, such as a soft drink, up to a designated liquid level 42. The liquid in the bottle acts as a prism and as a lens, the latter especially in the vicinity of the shoulder section 20. For example, when viewed obliquely from above as shown in the drawings, the top edge of the label 30 appears to extend as high as the numeral 44 on the far side of the bottle. This makes the liquid itself to appear to be tinted the color of the inside 34 of the label even at the portions above the label 30 and below the level 44. Furthermore, refraction at the air/liquid interface 42 creates a second image 46 of the top edge of the rear side of the label 30 above the first-mentioned image 44, which further enhances the impression of a colored liquid.

In cases where at least the inner surfaces of the base cup 22 are tinted to match the inside of the label 30, the liquid visible between the top of the base cup and the bottom of the label will similarly appear to be tinted.

The invention is best applied to strictly curvilinear bottles. Sharp edges or corners in the body 12 of the bottle or in the label 30 will show up as lines or creases in the colored background of the liquid, which would greatly detract from the illusion of a tinted liquid. As long as the images of the inside of the label are completely uniform and featureless, the coloration will appear to be due to the color of the liquid itself rather than of a background surface.

The dimensional relationship between the label and the bottle also has an effect on the apparent coloration of the liquid. If there is too much space above the label, there will be a noticeable gap between the primary image 44 of the top edge of the inside of the label and the top of the bottle. On the other hand, there must be some space above the top of the label to allow the inside surface to be visible at all. Therefore, the height of the unlabeled section 24 may be between 0.1 and 2.0 times the diameter of the bottle. Tests show that the best effects are achieved in the range of 0.5 to 1.2 diameters.

It should be noted that the invention has been explained in terms of a preferred embodiment for the sake of clarity, but that this embodiment is not necessarily the only mode of realization of the invention. The invention, which is delimited solely by the principles set forth in the appended claims, may be embodied in various ways by those skilled in the art. For example, though the shown embodiment employs a label, the backside of which is tinted by a mono-color, it should be possible to use a label with a multi-colored or patterned backside.

What is claimed is:

1. A transparent liquid container bottle comprising:

a transparent bottle body designed to be filled to a predetermined level with a transparent liquid;

a label adhering to and encircling more than half of the circumference of said bottle body, the surface of said label facing said bottle body being tinted, whereby said liquid appears to be tinted; and a base cup fixed to the bottom of said bottle body and tinted to match the color of said tinted surface of said label.

2. The transparent liquid container bottle as set forth in claim 1, further comprising means defining a relatively narrow opening at the top of said bottle body and a shoulder section smoothly conjoining said bottle body and said opening means, and wherein said predetermined level lies in said shoulder section near said opening means.

3. The transparent liquid container bottle as set forth in claim 2, wherein said bottle body and said shoulder section are strictly curvilinear in cross-section.

4. The transparent liquid container bottle as set forth in claim 3, wherein said bottle body is essentially cylindrical and has an unlabeled section between a top edge of said label and a lower edge of said shoulder section, the top-to-bottom dimension of the unlabeled section being in the range of 0.1 to 2.0 times the diameter of said bottle body.

5. The transparent liquid container bottle as set forth in claim 4, wherein the dimension of said unlabeled section lies in the range of 0.5 to 1.2 times the diameter of said bottle body.

* * * * *